US010117514B2

(12) United States Patent
Karu et al.

(10) Patent No.: US 10,117,514 B2
(45) Date of Patent: Nov. 6, 2018

(54) DRAWER WALL ELEMENT AND FILLER ELEMENT FOR A DRAWER WALL, AND ITEM OF FURNITURE

(71) Applicant: GRASS GMBH, Hoechst (AT)

(72) Inventors: Felix Karu, Altach (AT); Matthias Koenig, Goetzis (AT); Joseph Kruijen, Buch (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 15/183,987

(22) Filed: Jun. 16, 2016

(65) Prior Publication Data

US 2016/0360884 A1 Dec. 15, 2016

Related U.S. Application Data

(63) Continuation of application No. PCT/EP2014/078573, filed on Dec. 18, 2014.

(30) Foreign Application Priority Data

Dec. 20, 2013 (DE) ..... 20 2013 011 425 U

(51) Int. Cl.
*A47B 88/90* (2017.01)
*A47B 88/00* (2017.01)

(52) U.S. Cl.
CPC ..... *A47B 88/0014* (2013.01); *A47B 88/941* (2017.01); *A47B 2210/02* (2013.01); *A47B 2210/094* (2013.01)

(58) Field of Classification Search
CPC ..... A47B 88/0014; A47B 88/941; A47B 2210/02; A47B 2210/094; A47B 88/90
(Continued)

(56) References Cited

U.S. PATENT DOCUMENTS 3,687,512 A * 8/1972 Alston ..... A47B 88/941 312/348.2
4,099,815 A * 7/1978 Cox ..... F16B 12/40 312/111
(Continued)

FOREIGN PATENT DOCUMENTS

AT 401 853 B 12/1996
AT 407 332 B 2/2001
(Continued)

OTHER PUBLICATIONS

German Search Report (Application No. 20 2013 011 425.8) dated Dec. 5, 2014.
(Continued)

*Primary Examiner* — James O Hansen
(74) *Attorney, Agent, or Firm* — Burr & Brown, PLLC

(57) ABSTRACT

A drawer wall element for a drawer. A marginal section of a drawer base is insertable to form a drawer side wall that adjoins the drawer base. The drawer wall element comprises a wall profile part and a base-receiving profile part. The drawer wall element comprises a support surface, present on the base-receiving profile part, for providing underside support to the drawer base. The wall profile part comprises a chamber section having an inner wall sheet section and an outer wall sheet section. A filler element is inserted into the chamber section. The filler element comprises a spring element, which in an inserted state has a defined pretension.

11 Claims, 3 Drawing Sheets

(58) Field of Classification Search
USPC ..... 312/330.1, 348.1, 348.2, 348.4
See application file for complete search history.

(56) References Cited

U.S. PATENT DOCUMENTS

| | | | | |
|---|---|---|---|---|
| 4,128,284 | A * | 12/1978 | King | A47B 88/941 312/263 |
| 5,292,190 | A | 3/1994 | Lautenschläger et al. | |
| 6,053,593 | A | 4/2000 | Röck | |
| 7,857,404 | B2 * | 12/2010 | Lam | F16B 12/46 312/263 |
| 2008/0315740 | A1 | 12/2008 | Lam et al. | |

FOREIGN PATENT DOCUMENTS

| | | | |
|---|---|---|---|
| DE | 40 04 332 | A1 | 8/1991 |
| DE | 20 2008 002 447 | U1 | 7/2009 |
| DE | 20 2011 000 393 | U1 | 6/2011 |
| DE | 20 2011 110 018 | U1 | 1/2013 |
| WO | 2010/036215 | A2 | 4/2010 |

OTHER PUBLICATIONS

International Search Report and Written Opinion (Application No. PCT/EP2014/078573) dated Mar. 9, 2015.
English translation of International Preliminary Report on Patentability (Application No. PCT/EP2014/078573) dated Jun. 30, 2016.

* cited by examiner

DRAWER WALL ELEMENT AND FILLER ELEMENT FOR A DRAWER WALL, AND ITEM OF FURNITURE

CROSS REFERENCE TO RELATED APPLICATIONS

This application is a continuation of International Application No. PCT/EP2014/078573 filed Dec. 18, 2014, which designated the United States, and claims the benefit under 35 USC § 119(a)-(d) of German Application No. 20 2013 011 425.8 filed Dec. 20, 2013, the entireties of which are incorporated herein by reference.

FIELD OF THE INVENTION

The present invention related to a drawer wall element and filler element for a drawer wall, and item of furniture.

BACKGROUND OF THE INVENTION

In furniture comprising pull-outs or drawers which are displaceably mounted on a cabinet body of the furniture item via guides having telescopic rails, the pull-outs are generally assembled from prepared basic elements such as, for instance, two drawer side walls, a rear wall, a front wall and a drawer base. For stable and high-quality drawers, hollow drawer side walls made of metal are frequently used.

SUMMARY OF THE INVENTION

The object of the present invention is to provide drawers or drawer wall elements of the type described in the introduction in an improved form, in particular, as regards the stability and the usage characteristics of the drawer in practice.

The present invention is firstly based on a drawer wall element for a drawer, on which a marginal section of a drawer base is insertable in order to form a drawer side wall that adjoins the drawer base, wherein the drawer wall element comprises a wall profile part and a base-receiving profile part, wherein on the drawer wall element is provided a support surface, present on the base-receiving profile part, for providing underside support to a drawer base insertable on the drawer wall element, and wherein the wall profile part comprises a chamber section having an inner wall sheet section and an outer wall sheet section, which are spaced apart, one opposite the other, by a width dimension of the drawer wall element and are connected at the top by a connecting section.

Advantageously, the wall profile part and the base-receiving profile part respectively consist of a profile-like metallic sheet metal material having a thickness in the millimeter range, which is produced from a flat sheet section by bending, stamping and/or other machining steps, in particular, with a plurality of bending edges. Accordingly, both profile parts are in particular produced respectively in one piece, and then in particular connected to each other in a non-detachable manner to form the drawer wall element. The connecting section between the inner wall sheet section and the outer wall sheet section is formed, for instance, by a sheet section bounded by two bent-over sections. The base-receiving profile parts provide in particular the connection of the drawer base to the drawer wall element.

A drawer base is in particular panel-shaped, for example, made of a wood material.

The essence of the present invention lies in the fact that at least one filler element is inserted into the chamber section, which filler element comprises at least one spring element, which in the inserted state has a defined pretension. The at least one filler element is configured, in particular, as a separate component, which can be introduced in a positionally correct manner into the chamber section and is fixed self-lockingly therein. The spring element is, in particular, shaped such that it spans between inner sections of the chamber section or bears pressingly in resilient contact against at least one inner section of the chamber section, for example, against an inner side of the inner wall sheet section and/or of the outer wall sheet section. Loads acting on the drawer wall element can thus be at least partially absorbed by the filler element via the inner wall sheet section and/or the outer wall sheet section. This is mechanically and acoustically advantageous.

Advantageously, a drawer wall element can be individually equipped with one or more filler elements. Also the precise positioning of the filler elements in the chamber section can be differently chosen. Moreover, the type of filler elements which are housable in a chamber section can vary in size, shape and structure by selection from a range of different filler elements.

In particular as a result of the defined pretension, the housed filler elements advantageously produce a stabilization and a desired sound situation of the drawer wall element in the usage state or in respect of the finished drawer. The drawer can thus be subjected to a higher maximum load or be more heavily laden. Moreover, undesirable noises in the usage state of the drawer wall element are prevented or the sound of the drawer wall element improved, in particular, a comparatively deep sound is advantageously obtained. A comparatively high-pitched sound of a drawer wall element as a result of overlarge or vacant hollow regions is normally perceived by users as disagreeable.

In particular the at least one filler element presses against the inner wall and outer wall or in the horizontal direction and/or in the vertical direction, for example between the connecting section and a base-receiving profile part. The spring element can here bear against both mutually tensioned regions, or the spring element itself bears only against one of the two sections, while another region of the filler element, for example a frame section of the filler element, bears against the other section.

Advantageously, the at least one filler element is designed such that it is insertable into a wall profile part. Thus the installation or insertion of the filler element into the chamber section, in particular, on the end face of the wall profile part from the front or back, or via an open side of the chamber section, for example, becomes manually possible.

In addition, it is advantageous that the filler element is shaped such that in the inserted state it is resiliently supported against the base-receiving profile part. In general, the chamber section is open downward over the length of the drawer wall element. Only in some regions, or where a base-receiving profile part is provided over individual longitudinal sections of the drawer wall element, does a topside part of the base-receiving profile part form a lower boundary of the chamber section, so that the supporting of the filler element on its underside is advantageously possible there.

An advantageous modification of the subject of the invention is distinguished by the fact that at least one filler element is provided on a drawer rear wall connection unit. The drawer rear wall connection unit forms advantageous preconditions for fastening of the filler element thereto, in particular such that this is variously positionable. Moreover, in the region of the drawer rear wall connection unit, mechanically comparatively strong loads can arise, wherein, with the appropriate positioning of the filler element, the filler element has an effectively stabilizing effect.

It is also advantageous that at least one filler element is provided on a drawer front connection unit. Thus, in the front end region of the drawer wall element, an advantageous fitting option for the filler element is provided. The drawer front connection unit provides a plurality of and/or different mounting points for the fitting of precisely one filler element or of a plurality of filler elements.

Moreover, it is advantageous that the wall profile part and the base-receiving profile part are respectively shaped as separate and mutually matched components made from a sheet metal material and are connected to one another in mutual alignment to form the drawer wall element. Thus the multitude of parts can advantageously be reduced to precisely one variant for the base-receiving profile part. The wall profile part is defined only by its respective desired length, but is identical in terms of shape. For a respective chosen length of the wall profile part, the number of base receiving profile parts can be taken into account on an individualized basis. Accordingly, the length of a base-receiving profile part is normally significantly shorter than the length of a wall profile part.

The wall profile part and the base-receiving profile part are designed in particular for a compact arrangement comprising a partially nested arrangement, or for an inherently stabilizing connection by virtue of, for example, mutually abutting sections of the base-receiving profile part against mating sections of the wall profile part in their connection state, wherein the profile parts are preferably connected to each other in a mutually non-detachable manner, for example by welding together.

In particular, in the case of a comparatively shorter drawer wall element or wall profile part, precisely two base-receiving profile parts can be fitted and, in the case of a longer drawer wall element, or one with greater load-bearing capacity, more than two base-receiving profile parts can be fitted connectedly to the wall profile part.

The support surfaces of the plurality of base-receiving profile parts of a wall profile part are in mutual alignment or are part of a common, in particular horizontal plane, related to the usage state of the drawer.

It is also advantageous that present on the base-receiving profile part, above and at a distance from the support surface, is a web section, which, by virtue of a material bent-over section, connects to a bearing section, which is angled off from the support surface in the upward direction. In the case of a respectively right-angled bent-over section, with the support surface and the opposite, in particular, parallel web section and the bearing section which extends therebetween respectively at an angle to the support surface and the web section, a laterally open, channel-shaped receiving space for a longitudinal marginal section of a drawer base insertable on the drawer wall element is provided. The bearing section is advantageously supported, with its rear side facing away from the receiving space, against an extension section on the outer wall sheet section. The drawer wall element is thus of highly stable construction.

Moreover, it is advantageous that the web section bridges a distance between the outer wall sheet section and the inner wall sheet section, whereby also the support surface and the web section are formed over the width of the drawer wall element.

An additional contact surface, formed by the web section, for a top side of the marginal section of the insertable drawer base here extends alongside the support surface, also above the support surface, which increases the stability of the assembled drawer overall.

According to a further advantageous embodiment of the present invention, the filler element is supported against the web section. A supporting surface is thus obtained opposite to the connecting section for the underside support of the filler element in the chamber section.

Furthermore, it is advantageous that the filler element has a spring bow on the lower margin. A spring bow is easily creatable and enables, in addition to the provision of the defined pretension of the spring element, an underside support of the filler element against a mating section on the drawer wall element. Preferably, the spring bow is formed by a long hole, running in a curved path in the marginal direction of the filler element, over a substantial marginal length on the lower margin of the filler element. The spring or pretensioning characteristics of the filler element can be defined, for instance, by the height or width of the long hole and/or the material thickness of the material, adjoining the long hole, of the spring bow on the lower margin of the filler element. A lesser material thickness of the material, adjoining the long hole, of the spring bow flexes more easily than a greater material thickness. If, as a result of a larger or longer long hole, for example, comparatively more material is removed from the filler element, regardless hereof the spring characteristic of the spring bow or of the therewith provided pretensioned spring element is influenceable.

The present invention further relates to a filler element for a drawer wall element according to one of the above-stated configurations. The basic aspect lies in the fact that the filler element matched in shape to a chamber section of the wall profile part, having an inner wall sheet section and an outer wall sheet section, and comprises at least one spring element, which in a state inserted in the chamber section is tensioned. The drawer wall element is, in particular, designed as a hollow chamber casing made of a sheet metal material. In the inserted state, the spring element is, in particular, in bearing contact against an inner side of the chamber section, wherein the spring element is pressurized such that the spring element is pretensioned. Via the inner wall sheet section and/or the outer wall sheet section, the drawer wall element can at least partially absorb, by means of the filler element, loads acting on the drawer. With the filler element in the inserted state, the advantages discussed above with respect to the drawer wall element can thus be obtained.

The present invention further relates to a furniture item having a drawer wall element formed according to one of the above-stated embodiments. On the furniture item, for instance comprising a cabinet body and a plurality of drawers, mounted displaceably thereon, with hollow chamber casings, the corresponding advantages discussed above can be obtained.

BRIEF DESCRIPTION OF THE DRAWINGS

Further features and advantages of the invention are explained in greater detail on the basis of the schematically represented illustrative embodiments of the subject according to the invention.

DETAILED DESCRIPTION OF THE INVENTION

Figure 1:
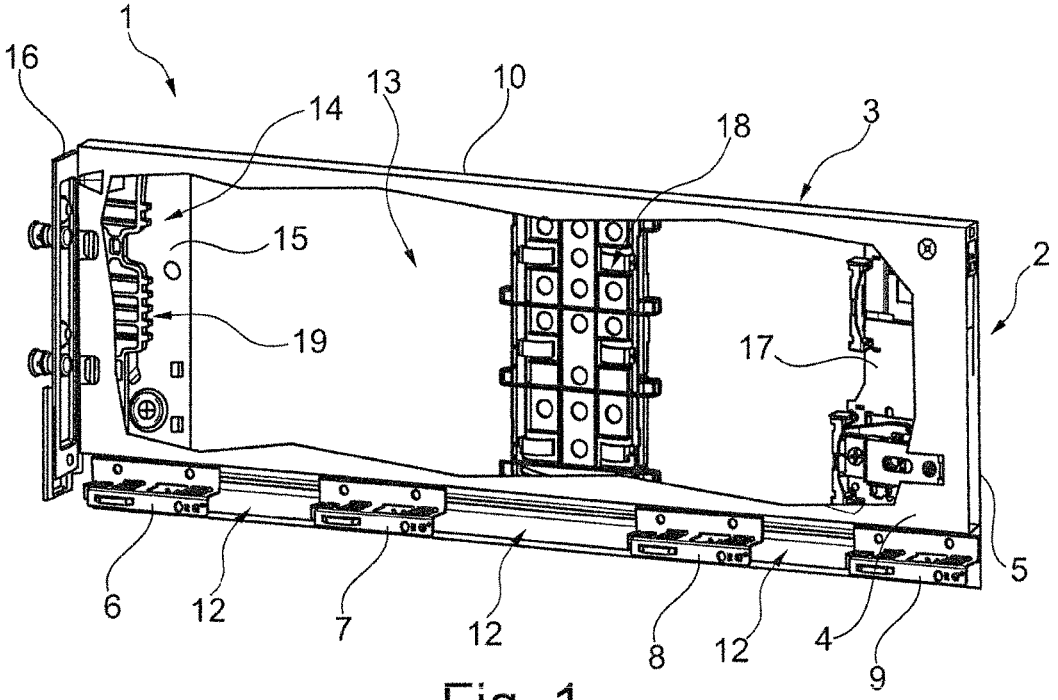
FIG. 1 shows a drawer wall element according to the present invention comprising a rear wall connection unit and a front connection unit in perspective view, wherein parts of the drawer wall element are omitted.

FIG. 1 shows in perspective view a drawer wall element 1 according to the invention, which is configured as a hollow chamber casing and is made of a sheet metal material. A wall profile part 3 of the drawer wall element 1 has a hollow chamber section 2, which is bounded by an inner wall sheet section 4 and an opposite outer wall sheet section 5, which extend in the longitudinal direction of the drawer wall element 1 over its basic height. The inner wall sheet section 4 and the outer wall sheet section 5 are connected to each other at their upper end via a web-like horizontal connecting section 10, which is formed by two right-angled bent-over sections.

For the representation of the inside of the chamber section 2, the inner wall sheet section 4 is represented only with its marginal regions. On the wall profile part 3, four identically configured base-receiving profile parts 6, 7, 8 and 9 are present, fixedly welded-on. The four base-receiving profile parts 6, 7, 8, 9 are likewise formed from sheet metal material having a plurality of bent-over sections or stamped-out regions. Each base-receiving profile part 6 to 9 respectively comprises a support surface region 11 for providing underside support to a drawer base (not represented), which latter is insertable on the drawer wall element 1 with a section of a longitudinal margin. Between the base-receiving profile parts 6 and 7, 7 and 8 and 8 and 9, a vacant intermediate region 12 without a base-receiving profile part is respectively obtained.

For the connection of the drawer wall element 1 to a rear wall (not represented) of a drawer constructable with the drawer wall element 1, a drawer rear wall connection unit 14, which on the inside is fixed with a section 15 to the outer wall sheet section 5 and reaches partially into the chamber section 2, is fitted to a rear region of the drawer wall element 1. Moreover, the drawer rear wall connection unit 14 comprises a section 16, which is oriented at an angle to the section 15 and at the rear end of the inner wall sheet section 4 protrudes at an angle over the total height thereof.

On a frontal end region of the drawer wall element 1, moreover, a drawer front connection unit 17 is present in a hollow space 13 of the chamber section 2.

For the stabilization or stiffening of the drawer wall element 1 and for an attunement of sound or noise characteristics of the drawer wall element 1 in the ready-mounted usage state of the drawer assembled with the drawer wall element 1, a plurality of filler pieces consisting of respectively separate components are in the inserted state present on the drawer wall element 1 in the hollow space 13 and clamped therein. When an object or a person bangs against the drawer or against the drawer wall element 1, or due to some other mechanical interrelationship, the drawer or the drawer wall element 1 or its inner wall sheet section 4 and/or its outer wall sheet section 5 are set vibrating in consequence of the hollow chamber section 2, whereby noises in a comparatively high pitch are generated, which is undesirable.

In order to avoid this, the filler pieces are provided in the chamber section 2. In the case of the drawer wall element 1, the filler pieces comprise a base filler element 18, a rear filler element 19, which is disposed on the drawer rear wall connection unit 14, and three further auxiliary filler elements 20, 21 and 22, which are detachably accommodated on, for example plugged onto, the drawer front connection unit 17.

All filler elements or filler pieces 18 to 22 consist of a suitable, in particular, noise-damping synthetic material and have in the inserted state according to FIG. 1 spring elements with a defined pretension.

Figure 3:
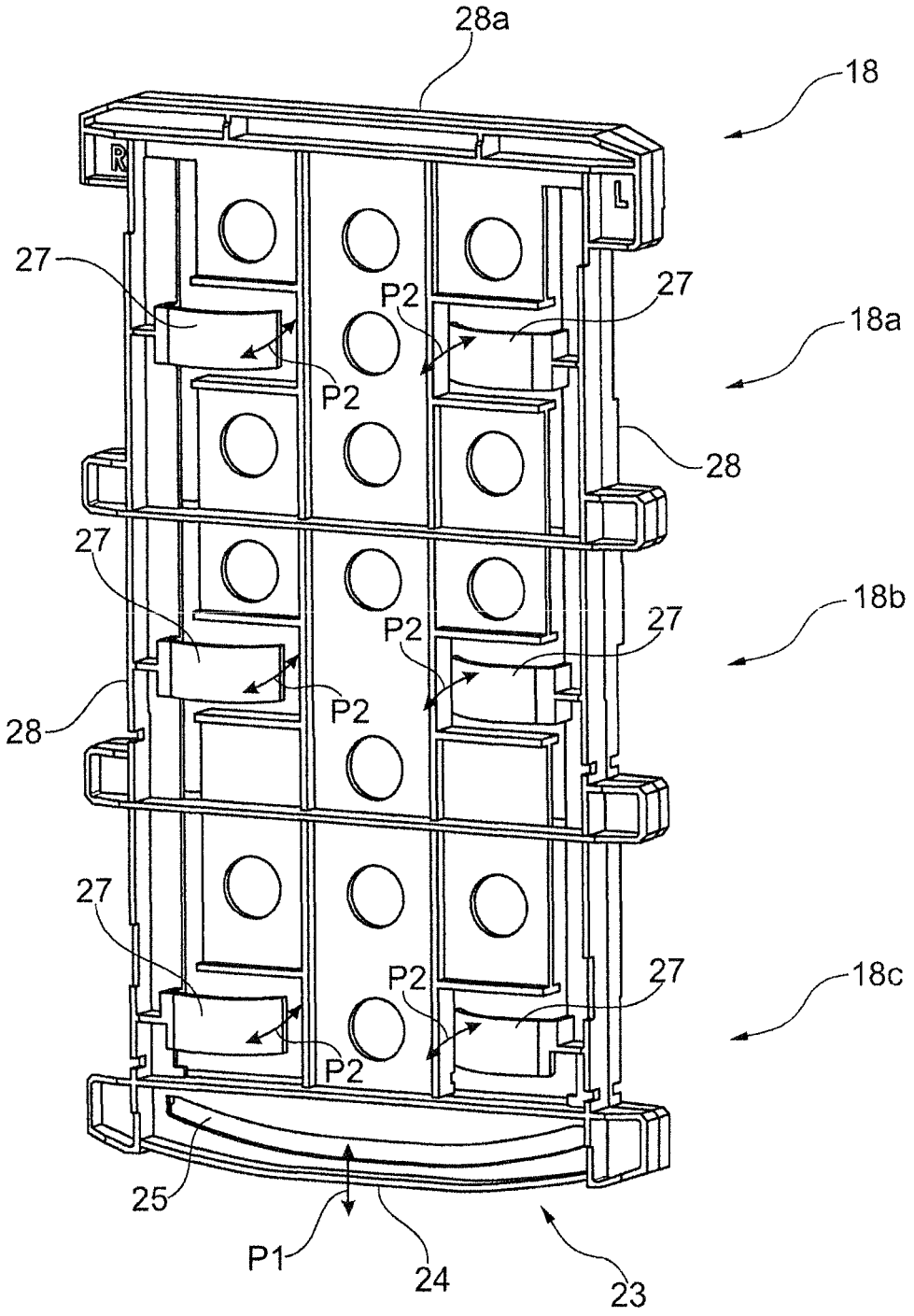
FIG. 3 shows a first filler element according to the present invention.

In the inserted state, the base filler element 18 represented on an enlarged scale in FIG. 3 extends vertically on the inside between the connecting section 10 and a lower part or the base-receiving profile part 8 on the drawer wall element 1. The base filler element 18 has at its lower end, as the definedly pretensioned spring element, a spring bow 23, which comprises a spring bar 24 and an arcuately elongate recess 25, which partially frees the spring bar 24. In the clamped-in state, the spring bar 24 can spring back somewhat upward in the direction of the recess 25 or downward, in particular, according to the double arrow P1, for example, by fractions of a millimeter, for instance when there are load peaks on the drawer wall element 1. Advantageously, the spring bar 24 is on the underside seated on a web section 26 of the base-receiving profile part 8. In the represented assembly position of the drawer wall element 1, the web section 26 is, in particular, oriented horizontally or roughly parallel to the support surface region 11 of the base-receiving profile part 8.

Figure 2:
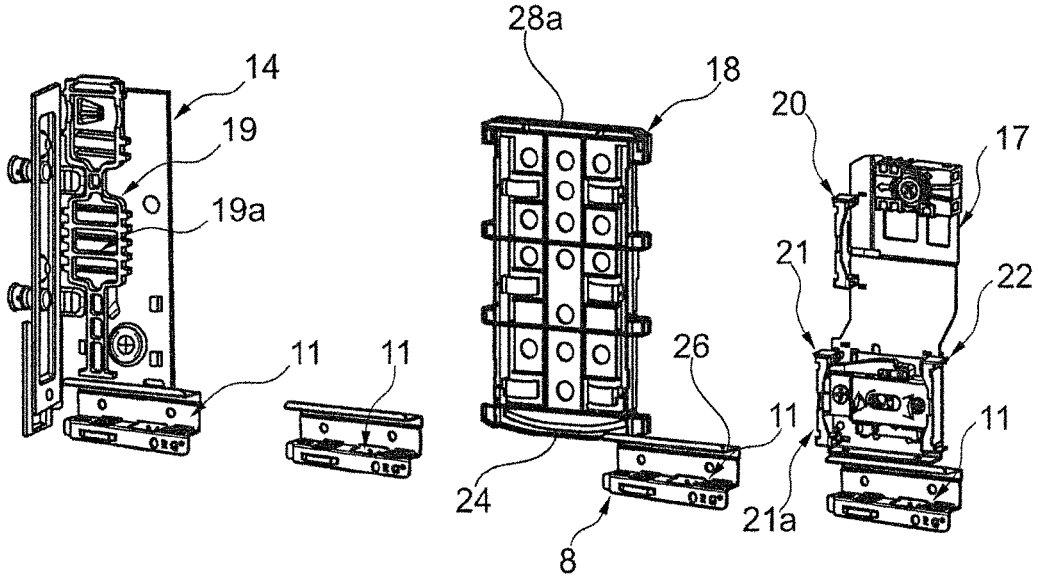
FIG. 2 shows the arrangement according to FIG. 1 without a wall profile part of the drawer wall element.

Advantageously, the arrangement on a drawer wall element can be such that that, exactly beneath a base filler element 18, a corresponding base-receiving profile part is centrally positioned. In FIGS. 1 and 2, the base filler element 18 is offset somewhat rearward relative to the middle of the base-receiving profile part 8, yet is supported against this on a part of the web section 26.

On the base filler element 18 are configured, moreover, a total of six slightly arcuately running spring elements 27, which are free on their end face and can rebound slightly according to P2. The spring elements 27 are convexly curved in the direction of an inner side of the inner wall sheet section 4. The base filler element 18 has a circumferential frame part 28, having recesses or material gaps in an inner region, framed by the frame part 28, of the base filler element 18.

On the base filler element 18, on a left half and a right half, three spring elements 27 are respectively configured one above another in an upper section 18*a*, a middle section 18*b* and in a lower section 18*c* of the base filler element 18 and connected on the frame part 28 via, in each case, a bending joint. The spring elements 27 lead to a defined pretension in the inserted state in the chamber section 2, wherein the spring elements 27 bear under pretension against the inner side of the inner wall sheet section 4, so that the spring elements 27 essentially provide a stiffening or stabilizing effect transversely to the longitudinal direction of the drawer wall element 1 by virtue of the base filler element 18 in the chamber section 2.

A corresponding stiffening or stabilizing effect in the vertical direction is rendered, in particular, by the spring bar 24.

High up on the inner side of the connecting section 10, the base filler element 18 is supported via a vertical frame bar 28*a*.

Figure 4:
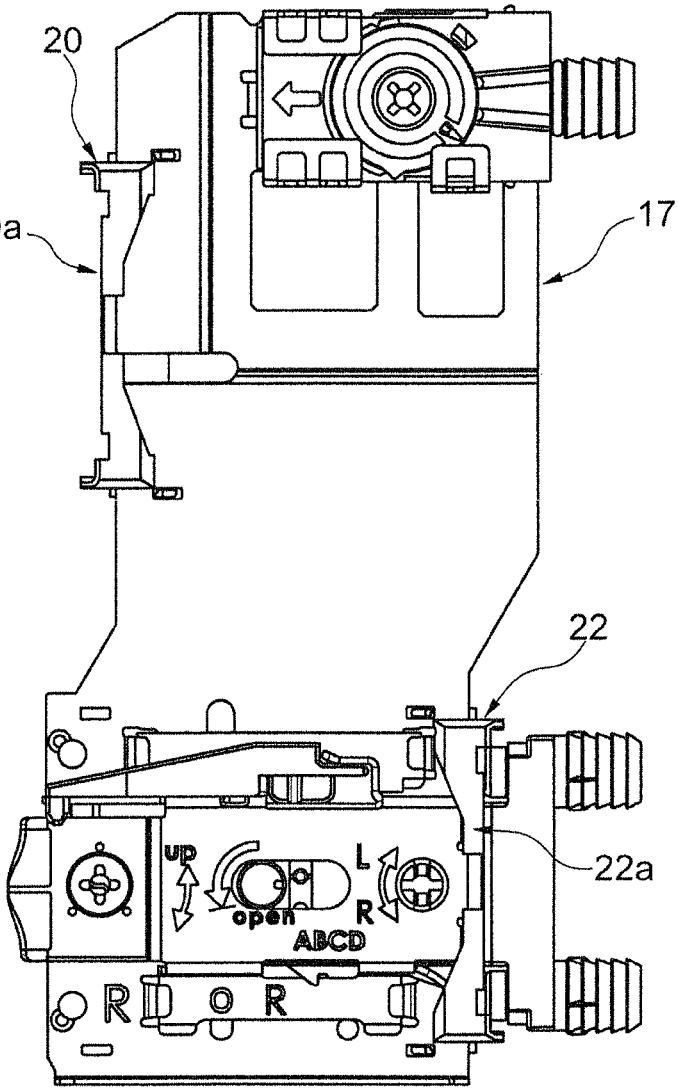
FIG. 4 shows further filler elements according to the present invention on a front connection unit.

On the drawer front connection unit 17 according to FIG. 4, which is represented in isolation on an enlarged scale, the auxiliary filler element 21 is omitted, in contrast to the view according to FIG. 2.

The auxiliary filler elements 20 to 22 serve in particular to brace the chamber section 2 in the front end region, or the filler element 19 on the rear wall connection unit 15 in the rear end region, between inner sides of the inner wall sheet section 4 and of the outer wall sheet section 5 and can behave in this direction somewhat resiliently, in particular, in order to absorb load or tension peaks on the inner wall sheet sections 4 or outer wall sheet sections 5. To this end, spring elements 19*a* or 20*a*, 21*a* and 22*a* are present on the filler elements 19 or 20-22.

With the stabilization and stiffening by virtue of the filler elements 18 to 22, a sound adaptation is also obtained moreover, to the effect that in the region of the chamber section 2 a resonance resulting from an external influence or a bump from outside against the drawer wall element 1 sounds comparatively deeper or vibration energy is absorbed and sounds less loud.

In addition, filler or noise-damping material, such as, for instance, foaming or self-hardening material such as polyurethane, can be introduced into the hollow space 13 of the chamber section 2 in order to have a stabilizing effect and to damp noises on the drawer wall element 1.

REFERENCE SYMBOL LIST

1 drawer wall element
2 chamber section
3 wall profile part
4 inner wall sheet section
5 outer wall sheet section
6 base-receiving profile part
7 base-receiving profile part
8 base-receiving profile part
9 base-receiving profile part
10 connecting section
11 support surface region
12 intermediate region
13 hollow space
14 drawer rear wall connection unit
15 section
16 section
17 drawer front connection unit
18 base filler element
18*a* section
18*b* section
18*c* section
19 filler element
19*a* spring element
20 auxiliary filler element
20*a* spring element
21 auxiliary filler element
21*a* spring element
22 auxiliary filler element
22*a* spring element
23 spring bow
24 spring bar
25 recess
26 web section
27 spring element
28 frame part
28*a* frame bar

The invention claimed is:

1. A drawer wall element for a drawer, on which a marginal section of a drawer base is insertable in order to form a drawer side wall that adjoins the drawer base, the drawer wall element comprising: a wall profile part having a first end and a second end defining a length therebetween, an upper edge and a lower edge defining a height therebetween, an inner wall sheet section and an outer wall sheet section extending in a vertical direction and joined together at the upper edge, defining a chamber having a width between the inner wall sheet section and the outer wall sheet section, at least one base-receiving profile part, extending from the lower edge of the wall profile part at an angle normal to the wall profile part, having a support surface for providing underside support to the drawer base insertable on the drawer wall element, at least one filler element, the at least one filler element including at least one spring element, the at least one spring element being configured such that it bears pressingly in resilient contact against one of an inner side of the inner wall sheet section or an inner side of the outer wall sheet section, and wherein the wall profile part and the base-receiving profile part are respectively shaped as separate and mutually matched components made from a sheet metal material and are connected to one another in mutual alignment to form the drawer wall element.

2. The drawer wall element as claimed in claim 1, wherein the at least one filler element is designed such that it is insertable into the wall profile part.

3. The drawer wall element as claimed in claim 1, wherein the at least one filler element is shaped such that in the inserted state it is resiliently supported against the base-receiving profile part.

4. The drawer wall element as claimed in claim 1, wherein one filler element of the at least one filler element is provided on a drawer rear wall connection unit.

5. The drawer wall element as claimed in claim 1, wherein one filler element of the at least one filler element is provided on a drawer front connection unit.

6. The drawer wall element as claimed in claim 1, further comprising a web section provided on the at least one base-receiving profile part, above and at a distance from the support surface, which, by a material bent-over section, connects to a bearing section which is angled off from the support surface in the upward direction.

7. The drawer wall element as claimed in claim 6, wherein the web section bridges a distance between the outer wall sheet section and the inner wall sheet section.

8. The drawer wall element as claimed in claim 6, wherein the at least one filler element is supported against the web section.

9. The drawer wall element as claimed in claim 1, wherein the at least one spring element comprises a spring bow.

10. The filler element for a drawer wall element as claimed in claim 1, wherein the at least one filler element is matched in shape to the chamber section of the wall profile part.

11. A furniture item having a drawer wall element according to claim 1.

* * * * *